US010815020B2

(12) United States Patent
Castellari et al.

(10) Patent No.: US 10,815,020 B2
(45) Date of Patent: Oct. 27, 2020

(54) UNIT AND METHOD FOR PLACING OBJECTS IN BOXES

(71) Applicant: GIMA S.p.A., Zola Predosa (Bologna) (IT)

(72) Inventors: Pierluigi Castellari, Castel San Pietro Terme (IT); Dario Rea, Monterenzio (IT); Massimiliano Medri, Imola (IT)

(73) Assignee: GIMA S.p.A., Zola Predosa (Bologna) (IT)

( * ) Notice: Subject to any disclaimer, the term of this patent is extended or adjusted under 35 U.S.C. 154(b) by 181 days.

(21) Appl. No.: 16/070,719

(22) PCT Filed: Feb. 3, 2017

(86) PCT No.: PCT/IB2017/050603
§ 371 (c)(1),
(2) Date: Jul. 17, 2018

(87) PCT Pub. No.: WO2017/137876
PCT Pub. Date: Aug. 17, 2017

(65) Prior Publication Data

US 2019/0055041 A1 Feb. 21, 2019

(30) Foreign Application Priority Data

Feb. 9, 2016 (IT) ..... 102016000013140

(51) Int. Cl.
*B65B 43/60* (2006.01)
*B65B 41/06* (2006.01)
(Continued)

(52) U.S. Cl.
CPC ..... *B65B 43/60* (2013.01); *B31B 50/024* (2017.08); *B31B 50/062* (2017.08); *B31B 50/07* (2017.08);
(Continued)

(58) Field of Classification Search
CPC ..... B65B 43/60; B65B 43/10; B65B 43/145; B65B 43/185; B65B 43/265; B65B 43/46;
(Continued)

(56) References Cited

U.S. PATENT DOCUMENTS 3,813,849 A * 6/1974 Stambera ..... B65B 11/32 53/234
4,428,177 A * 1/1984 Focke ..... B65B 19/225 493/142
(Continued)

FOREIGN PATENT DOCUMENTS

DE 10261943 A1 8/2003
EP 0569340 A1 11/1993
(Continued)

OTHER PUBLICATIONS

International Search Report and Written Opinon dated Apr. 28, 2017 for counterpart PCT Application No. PCT/IB2017/050603.
(Continued)

*Primary Examiner* — Dariush Seif
(74) *Attorney, Agent, or Firm* — Shuttleworth & Ingersoll, PLC; Timothy J. Klima

(57) ABSTRACT

A unit for boxing packaged food products including: a first rotary element with at least one first receiving seat; a first transfer station for transferring a blank from a magazine for feeding blanks to the first receiving seat; a folding station for opening up the blank; a second rotary element with at least one second receiving seat; a second transfer station for transferring the blank folded open from the first receiving seat to the second receiving seat; an insertion station for inserting the packaged food products inside the blank folded open positioned on the second receiving seat; and a closing
(Continued)

station for closing the blank folded open, positioned on the second receiving seat and containing the packaged food products.

19 Claims, 13 Drawing Sheets

(51) Int. Cl.

| | |
|---|---|
| ***B65B 43/14*** | (2006.01) |
| ***B65B 43/18*** | (2006.01) |
| ***B65B 43/26*** | (2006.01) |
| ***B65B 43/46*** | (2006.01) |
| ***B65B 5/02*** | (2006.01) |
| ***B65B 5/06*** | (2006.01) |
| ***B65B 5/08*** | (2006.01) |
| ***B65B 61/28*** | (2006.01) |
| ***B65B 51/02*** | (2006.01) |
| ***B31B 50/02*** | (2017.01) |
| ***B65B 43/10*** | (2006.01) |
| ***B31B 50/06*** | (2017.01) |
| ***B31B 50/44*** | (2017.01) |
| ***B31B 50/78*** | (2017.01) |
| ***B31B 50/62*** | (2017.01) |
| ***B31B 50/07*** | (2017.01) |
| *B65B 7/20* | (2006.01) |
| *B31B 100/00* | (2017.01) |
| *B65B 29/02* | (2006.01) |

(52) U.S. Cl.
CPC ..... *B31B 50/444* (2017.08); *B31B 50/622* (2017.08); *B31B 50/788* (2017.08); *B65B 5/024* (2013.01); *B65B 5/06* (2013.01); *B65B 5/08* (2013.01); *B65B 41/06* (2013.01); *B65B 43/10* (2013.01); *B65B 43/145* (2013.01); *B65B 43/185* (2013.01); *B65B 43/265* (2013.01); *B65B 43/46* (2013.01); *B65B 51/02* (2013.01); *B65B 61/28* (2013.01); *B31B 50/442* (2017.08); *B31B 2100/0026* (2017.08); *B31B 2100/0028* (2017.08); *B65B 7/20* (2013.01); *B65B 29/02* (2013.01); *B65B 2220/02* (2013.01); *B65B 2220/16* (2013.01)

(58) Field of Classification Search
CPC ..... B65B 11/28; B65B 11/48; B65B 5/024; B65B 5/06; B65B 5/08; B65B 41/06; B65B 51/02; B65B 61/28; B65B 7/20; B65B 29/02; B65B 2220/02; B65B 2220/16; B31B 50/07; B31B 50/788; B31B 50/622; B31B 50/444; B31B 50/062; B31B 50/024; B31B 5/442; B31B 2100/0026; B31B 2100/0028
USPC ..... 53/575, 228, 458, 466, 491, 232, 234, 53/170, 171; 493/315, 123, 309
See application file for complete search history.

(56) References Cited

U.S. PATENT DOCUMENTS

| | | | | | |
|---|---|---|---|---|---|
| 4,509,310 | A * | 4/1985 | Focke | B65B 11/58 | 53/170 |
| 4,617,780 | A * | 10/1986 | Focke | B65B 11/004 | 53/202 |
| 4,718,882 | A * | 1/1988 | Bressler | B31B 50/00 | 493/164 |
| 4,887,408 | A * | 12/1989 | Mattei | B29C 65/18 | 53/412 |
| 4,947,617 | A * | 8/1990 | Focke | B65B 11/004 | 53/202 |
| 5,718,103 | A * | 2/1998 | Spada | B65B 11/32 | 53/148 |
| 5,732,533 | A * | 3/1998 | Focke | B65B 51/023 | 53/234 |
| 6,035,612 | A * | 3/2000 | Draghetti | B65B 11/42 | 53/176 |
| 6,085,494 | A * | 7/2000 | Lembke | B65B 11/004 | 53/228 |
| 6,164,041 | A * | 12/2000 | Focke | B65D 85/1072 | 53/448 |
| 6,439,239 | B1 * | 8/2002 | Spatafora | B65B 19/226 | 131/58 |
| 6,510,671 | B2 * | 1/2003 | Focke | B65B 11/34 | 493/437 |
| 6,516,589 | B1 * | 2/2003 | Draghetti | B29C 66/8226 | 53/376.7 |
| 6,708,466 | B2 * | 3/2004 | Spatafora | B65B 11/32 | 53/173 |
| 6,904,738 | B2 * | 6/2005 | Spatafora | B65B 11/30 | 53/228 |
| 8,037,664 | B2 * | 10/2011 | Squarzoni | B65B 19/228 | 53/466 |
| 2002/0020150 | A1 * | 2/2002 | Spatafora | B65B 19/20 | 53/466 |
| 2002/0189208 | A1 * | 12/2002 | Spatafora | B65B 19/225 | 53/466 |
| 2005/0005580 | A1 * | 1/2005 | Spatafora | B65B 19/228 | 53/466 |
| 2005/0126128 | A1 * | 6/2005 | Spatafora | B65B 19/226 | 53/466 |
| 2006/0076111 | A1 * | 4/2006 | Spatafora | B65C 9/1826 | 156/569 |
| 2006/0243786 | A1 * | 11/2006 | Martelli | B65B 43/265 | 232/35 |
| 2007/0144546 | A1 * | 6/2007 | Spatafora | B65B 19/28 | 131/368 |
| 2008/0202681 | A1 * | 8/2008 | Spatafora | B65C 1/042 | 156/308.2 |
| 2009/0288371 | A1 * | 11/2009 | Squarzoni | B65B 19/226 | 53/456 |
| 2009/0291815 | A1 * | 11/2009 | Cavallari | B31B 50/00 | 493/173 |
| 2012/0291398 | A1 * | 11/2012 | Draghetti | B65B 19/228 | 53/170 |

FOREIGN PATENT DOCUMENTS

| | | | |
|---|---|---|---|
| EP | 1707491 | A2 | 10/2006 |
| EP | 2528823 | A1 | 12/2012 |
| WO | WO2010015950 | A1 | 2/2010 |

OTHER PUBLICATIONS

Italian Search Report dated Oct. 19, 2016 for counterpart Italian Patent Application No. IT UB20160589.

* cited by examiner

UNIT AND METHOD FOR PLACING OBJECTS IN BOXES

TECHNICAL FIELD

This invention relates to a unit and a method for boxing objects (that is, placing objects in boxes), in particular packaged food products, such as single-use capsules (containing infusion and/or extraction products such as, for example, coffee, tea, etc., or soluble products, or food products in general, such as marmalade, creams) or single-use packages of processed cheese, etc.).

BACKGROUND ART

It should be noted that the expression "packaged food products" is to be considered to mean hereafter food products positioned inside suitable packages (so-called primary packaging), of various types and type.

For example, in the case of products such as packaged cheese, the package consists of a piece of sheet (compatible with food products) wrapping and enclosing the food product.

On the other hand, for products such as packaged coffee, the package consists of a wrapper enclosing the coffee powder (so-called capsule).

Prior art single-use capsules containing infusion and/or extraction products, used in machines for making beverages, comprise, by way of non-limiting example, and in their simplest form, the following:

- a rigid, cup-shaped outer container comprising a perforatable or perforated bottom and an upper aperture provided with a rim (and usually, but not necessarily, having the shape of a truncated cone);
- a dose of product for extraction or infusion beverages contained in the outer container; and
- a length of sheet obtained from a web for sealing (hermetically) the aperture of the rigid container and designed (usually but not necessarily) to be perforated by a nozzle which supplies liquid under pressure.

Usually, but not necessarily, the sealing sheet is obtained from a web of flexible material.

In some cases, the capsules may comprise one or more rigid or flexible filtering elements.

For example, a first filter (if present) may be located on the bottom of the rigid container.

A second filter (if present) may be interposed between the piece of sealing sheet and the product dose.

The dose of product may be in direct contact with the rigid, cup-shaped outer container, or with a filtering element.

The capsule made up in this way is received and used in specific slots in machines for making beverages.

In the sector in question, that is to say, the production of capsules, so-called "boxing machines" are known of the horizontal type.

A boxing machine of the horizontal type typically comprises a belt for conveying cartons on a horizontal plane, already opened up and pre-glued, and a device for loading capsules positioned alongside the conveyor belt. Pusher devices pushers suitably synchronised and coordinated with the belt for conveying cartons push the capsules into the cartons along a direction parallel to the longitudinal direction of the carton. These boxing machines of the horizontal type are usually very long and bulky.

There are also prior art vertical machines, comprising a movement device which moves the boxes already opened up and pre-glued positioned vertically, and a device for insertion in the vertical direction. These vertical type machines are not generally used for inserting the capsules inside the boxes, since it is difficult to control the stacks of capsules, or objects in general, arranged vertically.

A strongly felt current need is that of providing a boxing machine which is able to carry out the simultaneous insertion of a plurality of objects, for example packaged food products, in a particularly quick and easy manner and which is also able to operate with boxes made and formed starting from flat blanks, which are more economical relative to pre-glued blanks.

DISCLOSURE OF THE INVENTION

The aim of this invention is therefore to provide a boxing unit and method for which are capable of inserting products of the single-dose capsule type inside boxes in a particularly simple and easy manner.

Yet another aim of this invention is therefore to provide a boxing unit and method for which are capable of inserting objects, preferably packaged food products (yet more preferably of the single-dose capsule type) inside boxes made starting from flat blanks.

Yet another aim of this invention is therefore to provide a boxing unit which can form a valid and effective alternative to the prior art machines.

A further aim of this invention is to provide a boxing unit or reduced size.

BRIEF DESCRIPTION OF THE DRAWINGS

The technical features of the invention, with reference to the above aims, are clearly described in the claims below and its advantages are apparent from the detailed description which follows, with reference to the accompanying drawings which illustrate a non-limiting example embodiment of the invention and in which:

FIG. 9 is partly in cross section;

DETAILED DESCRIPTION OF PREFERRED EMBODIMENTS OF THE INVENTION

With reference to the accompanying drawings, the numeral 1 denotes a unit for boxing objects, preferably a plurality of packed food products and even more preferably single-use capsules (containing preferably infusion or extraction products such as, for example, coffee, tea, herbal tea, etc., or soluble food products, or food products such as creams, marmalade, etc.), that is, a unit for inserting one or more objects in a box S formed starting from a flat blank SB (advantageously made from paper material).

This description will hereinafter refer to single-use capsules, but it is understood that the invention is not limited to these capsules, but is advantageously applied for any other object designed to be packaged in boxes, such as, for example, packaged food products, for example packaged in a primary packaging, such as individual packages of processed cheese, confectionery products and foodstuffs in general, etc.

The unit 1 is designed to open up (that is, form) a blank SB, for forming a box S, to insert products of the single-use capsules type inside the blank SB, and to close the blank SB.

The blank SB (FIG. 12) comprises a base or lower wall SB1, lateral walls (SB2, SB3, SB6, SB7, SB8, SB9, SB10, SB11, SB12, SB13), and at least one upper or closing wall (SB4, SB5).

The lateral walls (SB2, SB3, SB6, SB7, SB8, SB9, SB10, SB11, SB12, SB13), in combination with the base wall SB1, define a compartment for containing capsules.

Figure 1:
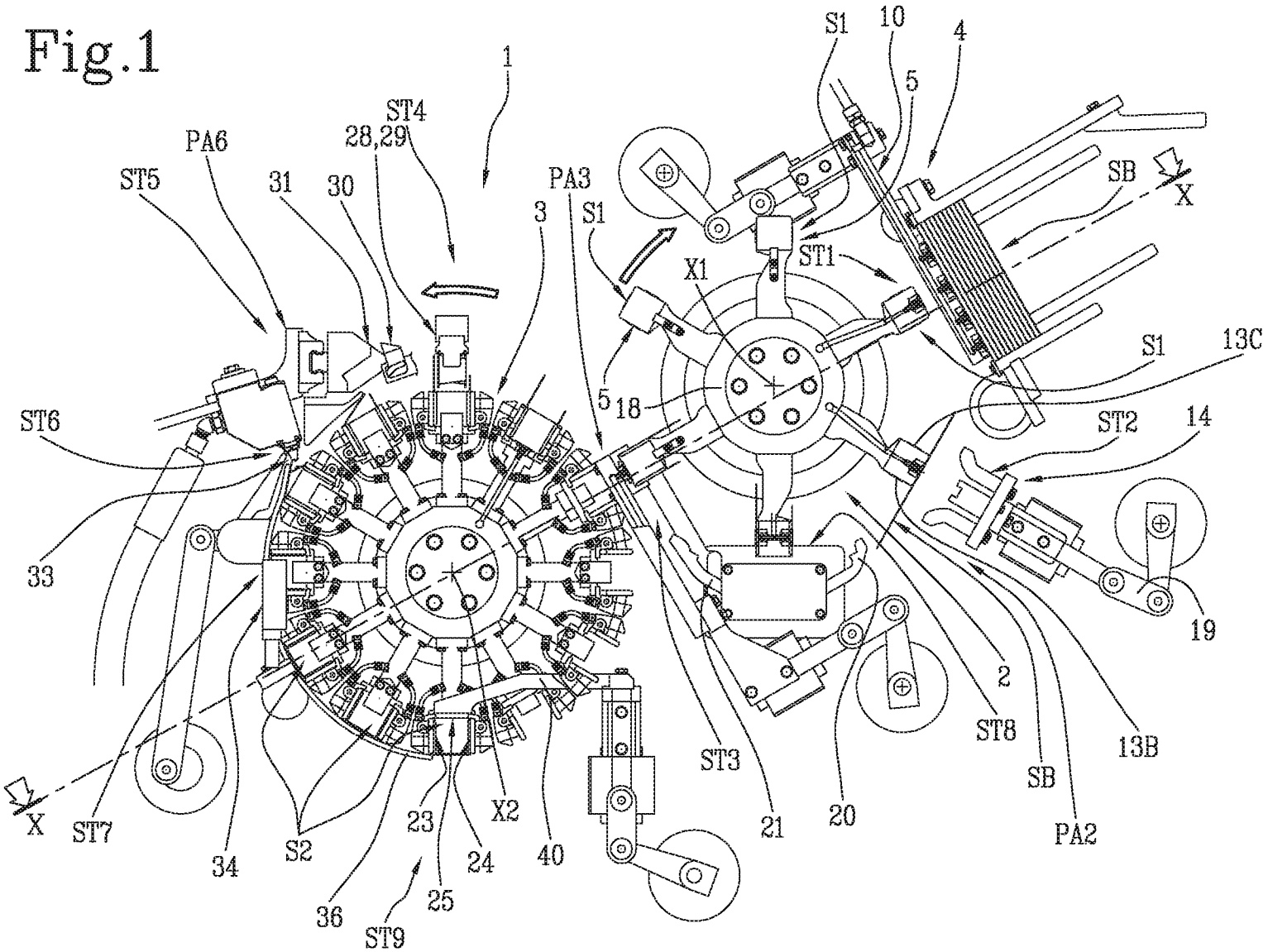
FIGS. 1 to 3 illustrate respective schematic front views, partly in cross section according to a vertical plane, of a unit for packaging single-use capsules according to the invention in different operating configurations according to a first embodiment.

According to the invention, the unit 1 for boxing single use capsules comprises a first rotary element 2, rotating about a first axis X1 of rotation (FIG. 1).

The rotary element 2 comprises at least one first seat S1 for receiving a blank SB and is designed to rotate the above-mentioned at least one first receiving seat S1 in a plurality of angular positions of rotation.

The first rotary element 2 comprises a rotary supporting body (or shaft) 18.

The first rotary element 2 is rotated preferably by means of an actuator; still more preferably by means of a drive unit.

More preferably, as illustrated, the first rotary element 2 comprises a plurality of first receiving seats S1, arranged in different angular positions (offset) of the first rotary element 2, with each of the first receiving seats S1 designed to receive, in use, a blank SB.

Figure 6:
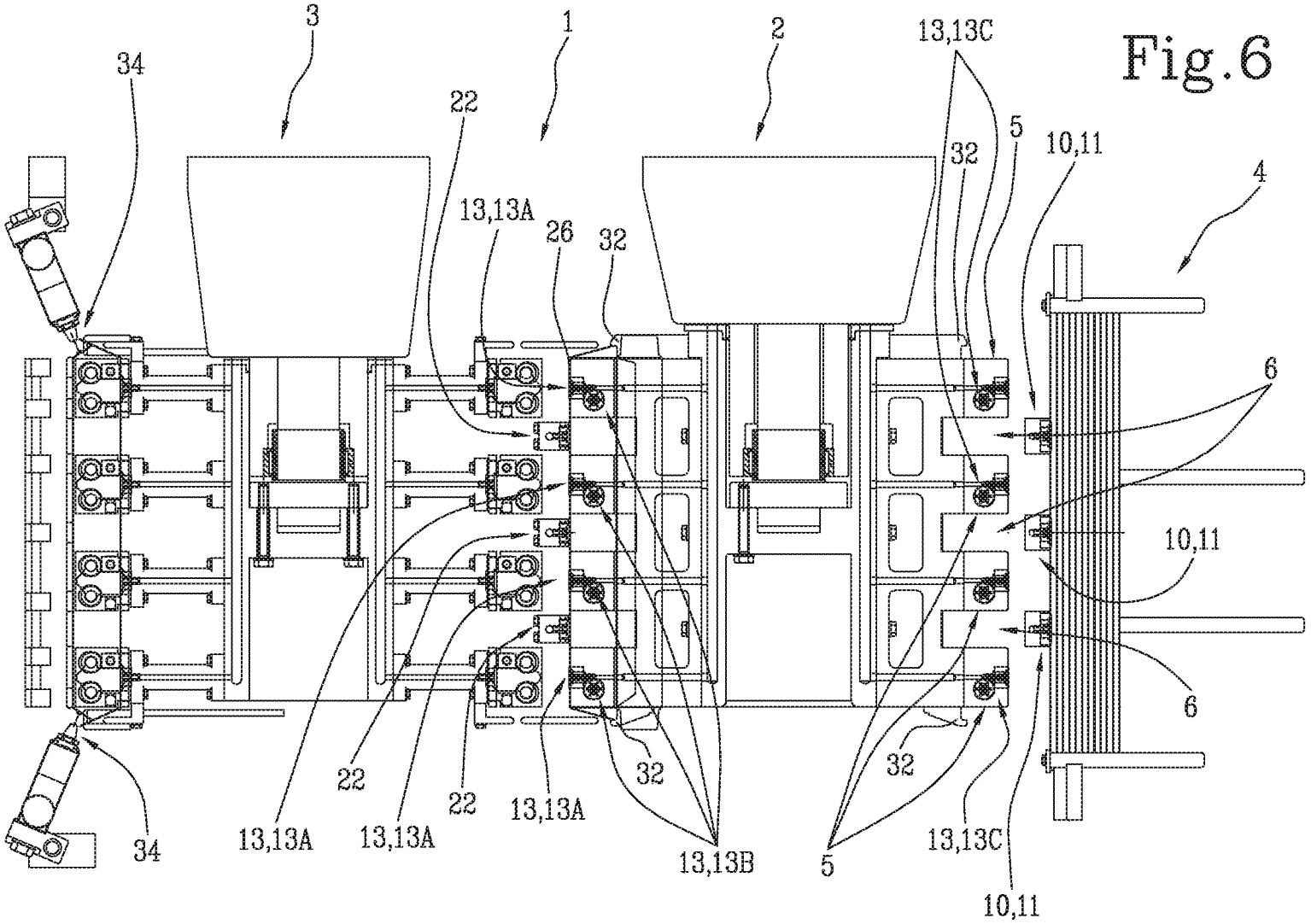
FIG. 6 illustrates a respective schematic cross section along the line XX-XX of FIG. 1 of a unit for boxing single-use capsules.
Figure 8:
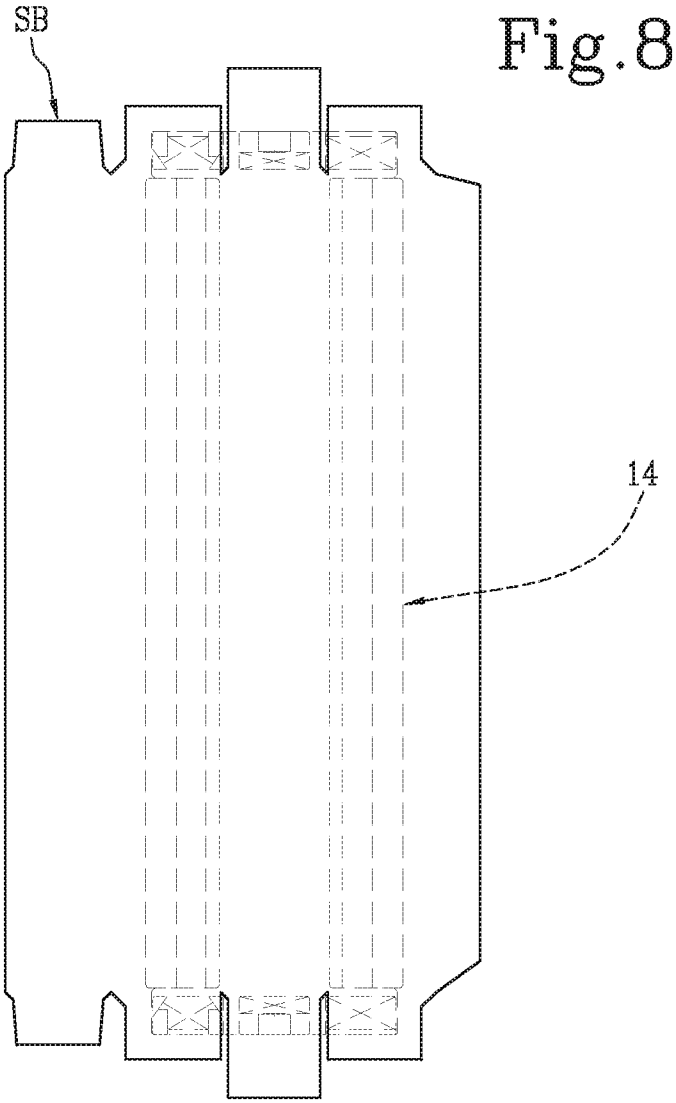
FIGS. 7 to 8 illustrate schematic views respectively of a detail of the boxing unit according to the previous drawings and of a blank SB.

According to another aspect, each first receiving seat S1 is defined by at least one projection 5, preferably by a plurality of projections 5 (radial), positioned substantially aligned along a direction parallel with the first axis X1, the projection(s) defining (with each other) respective cavities 6 (FIG. 6).

Reference will be made hereinafter to a plurality of projections 5, whilst it being understood that there might also be a single projection 5.

It should be noted, therefore, that more generally speaking the first rotary element 2 has at least one projection 5 defining the above-mentioned first receiving seat S1.

It should be noted that, preferably, the plurality of projections 5 (radial), are positioned substantially aligned along a direction parallel to the first axis X1 is supported by one or more arms projecting radially relative to the rotary supporting body 18.

According to the invention, the unit 1 comprises a first station ST1 for transferring a blank SB (in an extended configuration) from a magazine 4 for feeding blanks SB to the receiving seat S1, acting at a first predetermined angular position PA1 of rotation of the first seat S1. The expression "acting at a first predetermined angular position PA1 of rotation of the first seat S1" means that the first transfer station ST1 is positioned in a predetermined spatial position (fixed), and operates on a first seat S1 when the first seat S1, due to the rotation of the first rotary element 2, is in a first predetermined angular position PA1 of rotation (corresponding to a predetermined spatial position).

The feeding magazine 4 is designed to contain a plurality of blanks SB in the flat configuration, open and not pre-glued.

Figures 12, 13, 14:
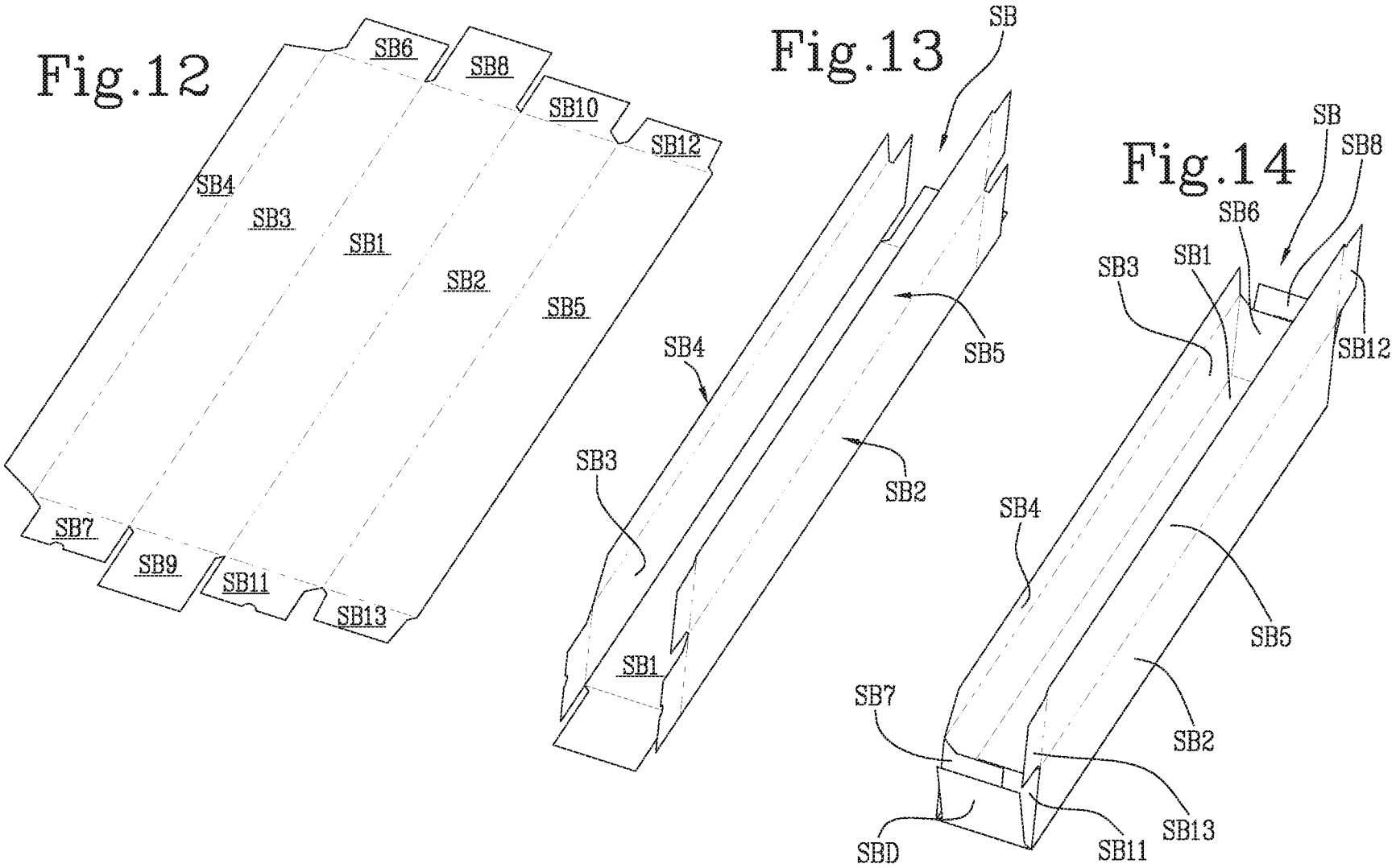
FIGS. 12 to 18 illustrate schematic views respectively of a blank SB, used in the unit according to the invention, in different operating steps.
Figures 15, 16, 17, 18:
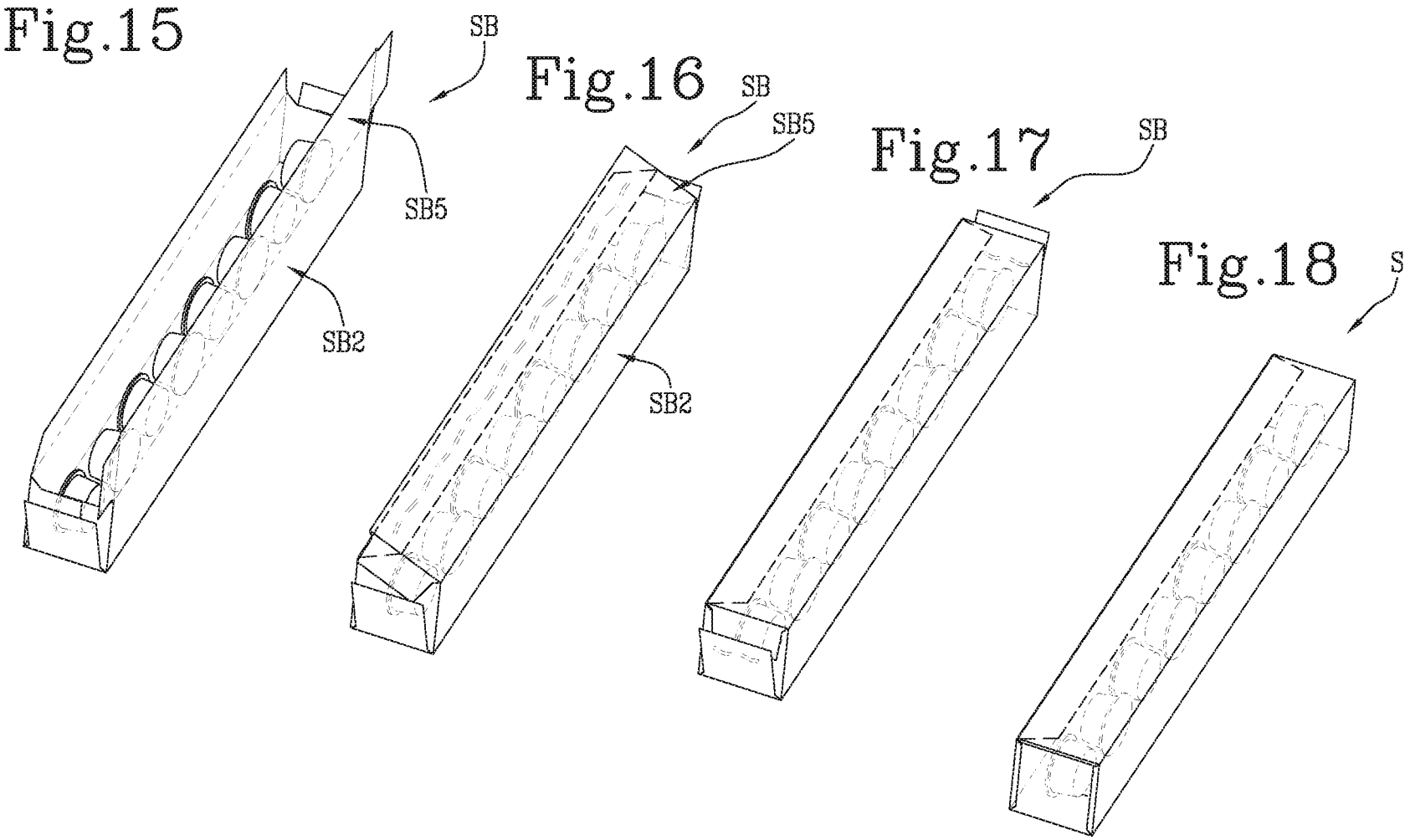

FIG. 12 shows a blank SB in the flat configuration, open and not pre-glued.

Reference is made below to the blank SB, without this limiting the scope of the invention.

The blank SB has a lower, or bottom, face SB1, a first lateral face SB2 and a second lateral face SB3.

Moreover, the blank SB has a first upper face SB4 and a second upper face SB5.

The blank SB also has a third lateral face (or first upper lateral) SB12 and a fourth lateral face (or second upper lateral) SB13, which are connected, respectively, at opposite ends of the second upper face SB5.

The blank SB comprises a fifth lateral face SB8 and a sixth lateral face SB9, which are connected, respectively, at opposite ends of the lower face SB1.

The blank SB comprises a seventh lateral face SB10 and an eighth lateral face SB11, which are connected, respectively, at opposite ends of the first lateral face SB2.

The blank SB comprises a ninth lateral face SB6 and a tenth lateral face SB7, which are connected, respectively, at opposite ends of the second lateral face SB3.

The blank SB has, in its flat configuration, two respective opposite surfaces (which are defined by the above-mentioned faces): a so-called "outer" surface, which in its final use (with box closed) at least partly faces towards the outside, that is, towards the user, and an "inner" surface, which in the final use faces towards the inside.

It should be noted that, inside the feeding magazine 4, the blanks SB are arranged in the flat configuration substantially aligned in contact with each other.

It should be noted that, preferably, the so-called "inner" surfaces are positioned facing towards the first rotary element 2, that is, towards the first seats S1 when they are positioned at the transfer station ST1.

According to the invention, the unit 1 comprises a station ST2 for folding open the blank SB positioned on the first receiving seat S1, acting in a second predetermined angular position PA2 of rotation of the first seat S1.

The folding station ST2 is designed to open up, at least partly, the blank SB.

It should be noted that the second predetermined angular position PA2 of rotation is preferably after the first angular position PA1.

According to another aspect of the invention, the unit 1 also comprises a second unit 3 rotating about a second axis X2 of rotation, comprising at least one second seat S2 for receiving the blank SB folded open.

Preferably, the second rotary element 3 comprises a plurality of second receiving seats S2, positioned in different angular positions, with each of the second seats S2 designed to receive, in use, a blank SB.

Preferably, the second axis X2 of rotation is parallel to the first axis X1 of rotation, Preferably, each second seat S2 is defined by the combination of a first series of radial projection 23, aligned with each other along a direction parallel to the second axis X2 and by a second series of radial projections 24, aligned with each other along the direction parallel to the second axis X2, and positioned relative to the radial projections of the first series in different and adjacent radial positions.

In other words, the second seat S2 is defined by lateral walls of the first series and second series of radial projections (23, 24)—mutually opposed—and by a bottom wall 25 (extending substantially along a direction parallel to the second axis X2).

It should be noted that the lateral walls of the first series and second series of radial projections (23, 24) and the bottom wall 25 are equipped with suction cups 27, which can be activated to retain the blank SB inside of the second seat S2.

According to another aspect of the invention, the unit 1 comprises a second station ST3 for transferring the blank SB folded open from the first receiving seat S1 to the second receiving seat S2, acting in a third predetermined angular position PA3 of rotation of the first receiving seat S1 and in a first predetermined angular position PA4 of rotation of the second receiving seat S2.

With reference to the second station ST3 for transferring the blank SB, it should be noted that—when the blank is positioned on the first seat S1—the inner part, that is to say, the inner surface (with reference to the final use) of the blank SB is in contact with the walls of the first seat S1 and the outer part, that is to say, the outer surface (with reference to the final use) of the blank SB faces towards the outer radial periphery of the rotary element 2.

A portion of the part, that is to say, the surface, outside of the blank SB is, on the other hand, in contact with the walls which define the second seat S2.

It should be noted, with reference to the accompanying drawings, that the first rotary element 2 and the second rotary element 3 preferably rotate according to different angular directions. Alternatively, the first rotary element 2 and the second rotary element 3 rotate according to concordant angular directions.

Advantageously, the first rotary element 2 rotates in a clockwise direction whilst the second rotary element 3 rotates in an anticlockwise direction. Alternatively, the first rotary element 2 rotates in an anticlockwise direction whilst the second rotary element 3 rotates in a clockwise direction.

According to an alternative embodiment not illustrated, the first rotary element 2 and the second rotary element 3 rotate in an anticlockwise direction.

According to yet another aspect of the invention, the unit 1 comprises a station ST4 for insertion of single-use capsules inside the blank SB folded open positioned on the second receiving seat S2, acting in a second predetermined angular position PA5 of rotation of the second receiving seat S2.

The ST4 station comprises, preferably, a device 28 for inserting capsules inside the blank SB opened up and contained in the second seat S2.

It should be noted that the device 28 for inserting capsules comprises an movable element 29 (shown in FIGS. 1 and 2), configured for retaining the capsules and moving the capsules from a position for picking up the capsules to a position for releasing the capsules inside the second seat S2.

Preferably, the movable element 29 is equipped with a gripper or one or more suction cups, configured to retain (and move) the capsules.

With reference to another aspect of the invention, the unit 1 also comprises a station ST5 for closing the blank SB folded open positioned on the second receiving seat S2 and containing the capsules to define a box S.

Preferably, the closing station ST5 comprises a fixed contact element 30 (upper faces of the blank SB) and a movable contact element 31 (upper faces of the blank SB).

The closing station ST5 acts in a third predetermined angular position PA6 of rotation of the second receiving seat S2.

According to another aspect of the invention, the unit 1 also comprises a first station ST6 for gluing first portions of the blank SB folded open positioned on the second receiving seat S2 and containing the capsules, acting in a predetermined fourth angular position of rotation of the second receiving seat S2 (preferably, the predetermined fourth angular position of rotation is subsequent to, or partly coinciding with, the third angular position in which the blank is closed, that is to say, when the operating station ST5 is active).

It should be noted that, preferably, the first gluing station ST6 provides for the gluing together of the first and second upper face SB4 and SB5.

Preferably, therefore, the first gluing station ST6 comprises a first device 33 for distributing (that is, releasing) glue.

Preferably, the first device for distributing (releasing) glue is movable (preferably along a direction parallel to the second axis X2).

Preferably, the unit 1 comprises a second station ST7 for gluing second portions of the blank SB folded open positioned on the second receiving seat S2 and containing the capsules.

Preferably, the second gluing station ST7 is positioned downstream of the first gluing station ST6.

Preferably, the second gluing station ST7 acts in a predetermined angular position of rotation of the second receiving seat S2 after an angular position of the second seat S2 in which the first gluing station ST6 is active. Alternatively, the second gluing station ST7 may be integrated, and positioned together, with the first gluing station ST6.

It should be noted that the second gluing station ST7 preferably comprises a second device 34 for distributing (releasing) glue.

The second device 34 for releasing glue is designed to distribute (release) glue at the third and fourth lateral faces, labelled SB12 and SB13.

According to another aspect, the station ST1 for transferring a blank SB from a magazine 4 for feeding blanks SB to the first receiving seat S1 comprises a transfer arm 10.

The transfer arm 10 comprises a plurality of prongs 11 (FIG. 6).

The prongs 11 are configured (dimensioned and shaped) to pass through the above-mentioned cavities 6 defined by the projections 5.

Figure 3:
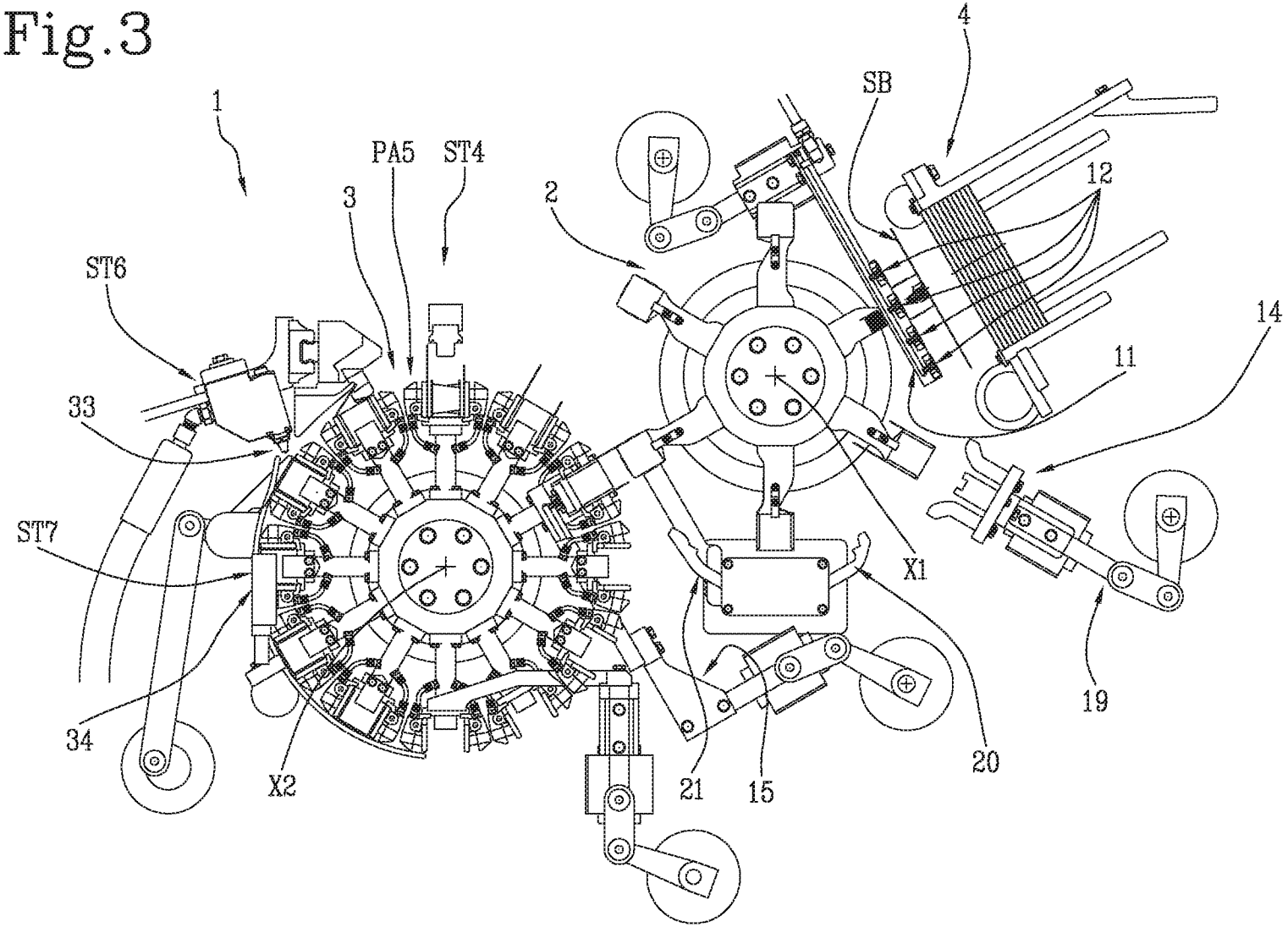

The transfer the arm 10 is movable between a position for picking up the blank SB from the feeding magazine 4 (illustrated in FIG. 1) and a position for releasing the blank SB on the first receiving seat S1 (illustrated in FIG. 3), wherein the prongs 11 are positioned inside the above-mentioned cavities 6.

According to another aspect, the prongs 11 comprise a plurality of suction cups 12, positioned facing towards the feeding magazine 4 for picking up the blank SB.

Preferably, each of the prongs 11 carries a plurality of suction cups 12.

Preferably, the projections 5 (defining the first seats 5) comprise a plurality of suction cups 13, configured for retaining the blank SB in a predetermined position.

Preferably, each projection 5 comprises a first suction cup 13A positioned on the outer radial periphery and a pair of suction cups (13B, 13C) positioned on both sides relative to a circumferential trajectory of the first receiving seat S1, that is to say, on two opposite lateral faces of the projections 5.

It should be noted that each first suction cup 13A is substantially activated, at the transfer station ST1, in a synchronised fashion with the suction cups 12 of the transfer arm 10: in particular the first suction cup 13A is activated when the suction cups 12 of the arm are to be deactivated and the prongs 11 are inserted inside the cavity 6, so as to allow the transfer of the blank SB from the arm 10 to the first seat S1.

During transfer of the blank SB by the arm 10 to the first seat S1 the first suction cups 13A of the projections 5 are aligned with the suction cups 12 of the arm 10.

According to another aspect, the folding station ST2 comprises a mould 14, movable radially between a non-operating position away from the first seat S1 (illustrated in FIG. 1) and an operating position (illustrated in FIG. 2) close to the first seat S1 wherein it comes into contact with the faces of the blank SB to carry out a folding (when the blank SB is coupled to the projection 5).

It should be noted that the mould 14 is configured to operate substantially in conjunction with the projections 5, in such a way as to cause a pre-forming of the blank (that is to say, an opening up of the blank SB, in an almost definitive configuration).

The mould 14 is carried by an arm 19, moved by means of an actuator.

Preferably, the arm 19 is guided along a predetermined rectilinear trajectory.

Also, preferably, the arm 19 is an articulated arm.

Figure 5:
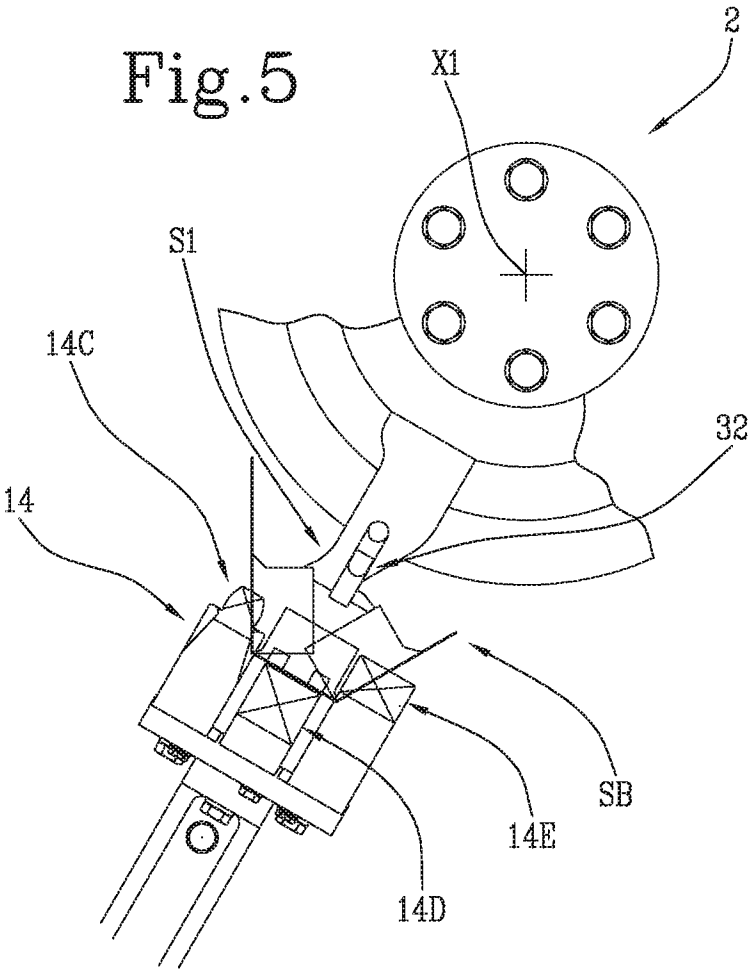
FIGS. 4 to 5 illustrate respective schematic front views of a detail of a unit for boxing single-use capsules according to the invention in different operating configurations.
Figure 4:
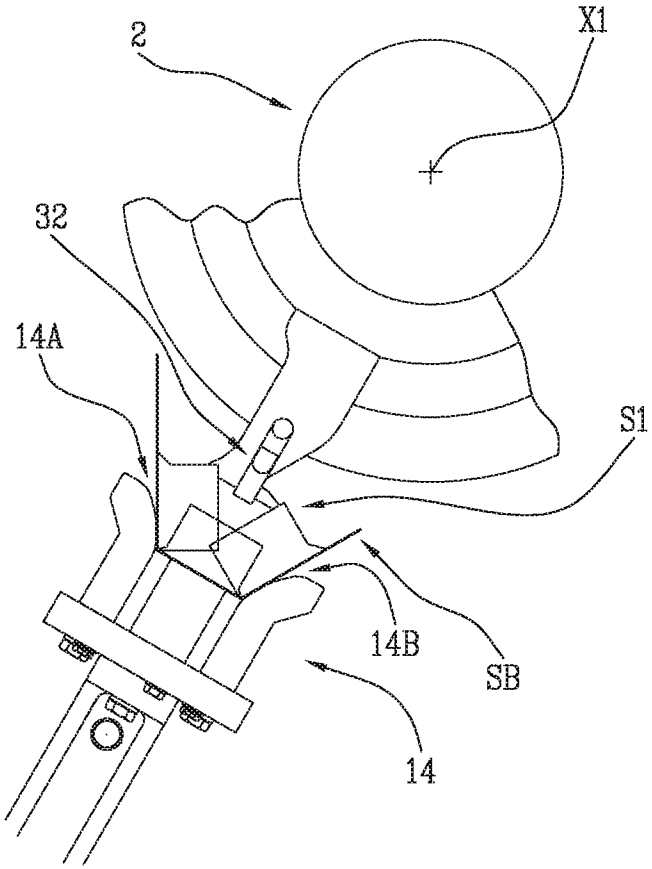
Figure 7:
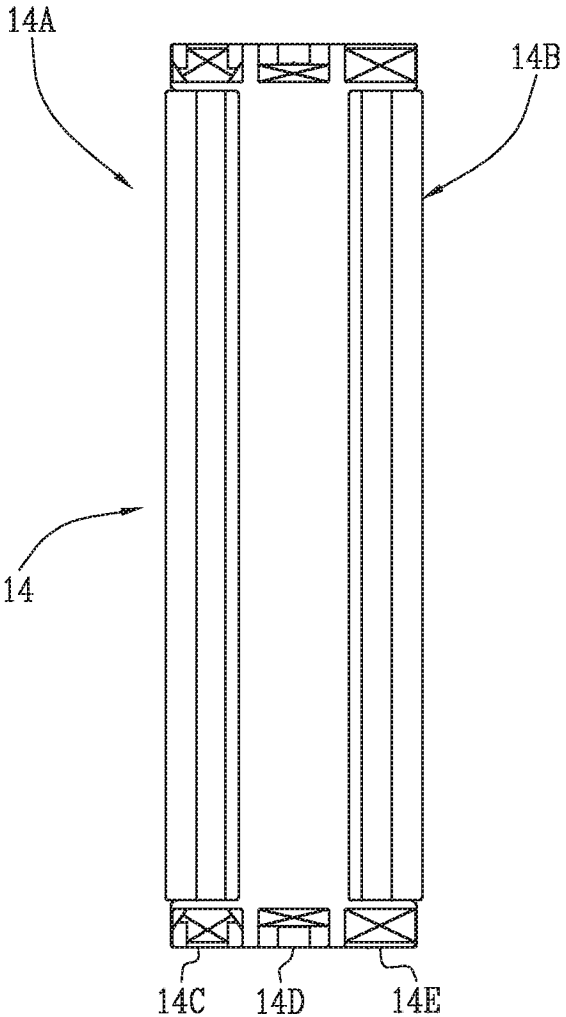
Figure 11:
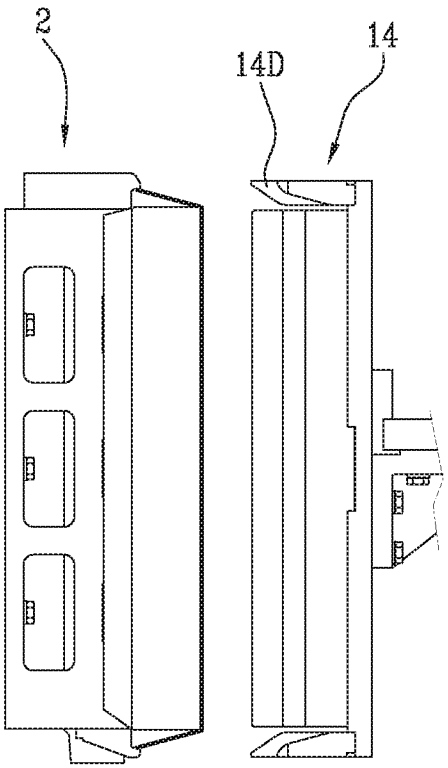
FIGS. 9, 10 and 11 illustrate schematic views of a detail of the boxing unit of FIGS. 1, 2 and 3, respectively.
Figure 10:
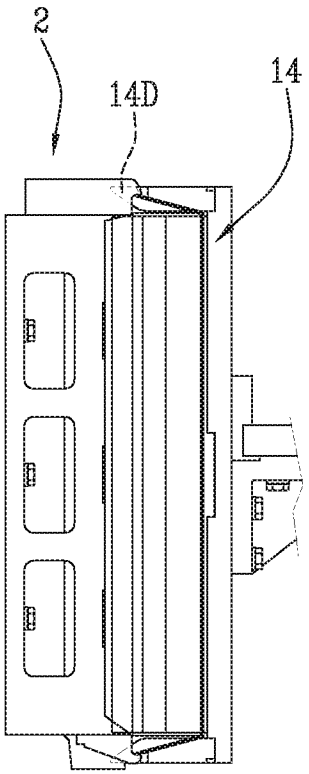
Figure 9:
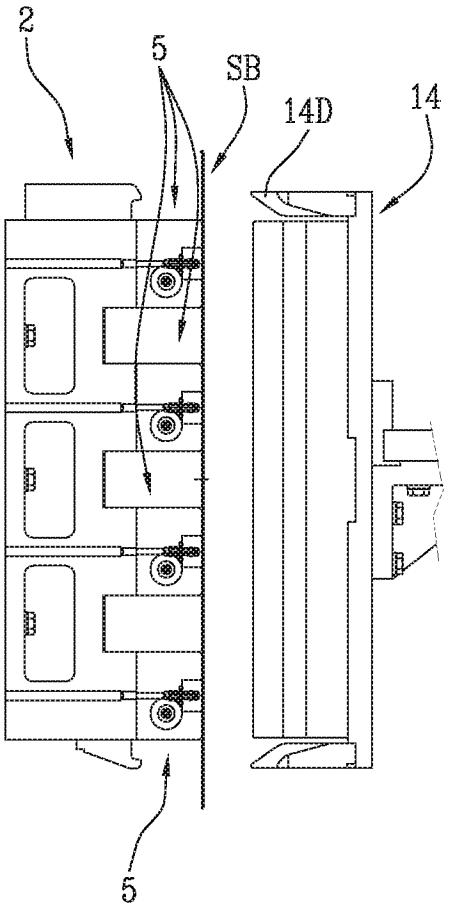

The mould 14 is illustrated in FIGS. 4, 5 and 7 and from FIGS. 9 to 11.

It should be noted that, preferably, the mould 14 comprises a first element 14A, designed to make contact with the first lateral face SB2 to make a fold (at 90°) and a second element 14B designed to make contact with the second lateral face SB3 to make a fold (at 90°).

Also, preferably, the mould 14 comprises further contact elements (for example, the elements illustrated in FIGS. 5 and 7 and from 9 to 11 and labelled 14C, 14D, 14E), preferably positioned in two different positions along a direction parallel with the first axis X1 of rotation (on opposite sides of the blank SB), to the folding of the lateral faces SB10, SB11, SB8, SB9, SB6 and SB7, respectively.

More specifically, a first group of further contact elements of the mould 14 is active at the faces SB10, SB8 and SB6 of the blank SB, to carry out substantially a folding at 90° whilst a second group of further contact elements is active at the faces SB11, SB7 and SB9 of the blank SB, to carry out substantially a folding at 90°.

It should be noted that, preferably, some projections 5, in particular the end ones, are equipped with a retaining element 32 (see FIGS. 4, 5 and 6): this element 32 is designed to retain in position, respectively, the face SB8 or the face SB9 once the same has been folded following the sliding movement of the mould 14.

It should be noted in particular that, at the folding station ST2, the blank is folded substantially to be configured as illustrated in FIG. 14: in particular, the faces SB2 and SB3 are positioned substantially at 90° relative to the face SB1 whilst the faces SB10 and SB6 are folded substantially at 90° so as to be positioned inside the face SB8 and the faces SB11 and SB7 are folded at 90° so as to be positioned inside the face SB9 (see FIG. 14).

With regard to the faces SB8 and SB9, they are folded by an angle of less than 90° and are fastened to the retaining element 32.

According to another aspect, the unit 1 comprises a deformation (that is to say, weakening) station ST8, acting in a predetermined angular position of the first receiving seat S1.

Figure 2:
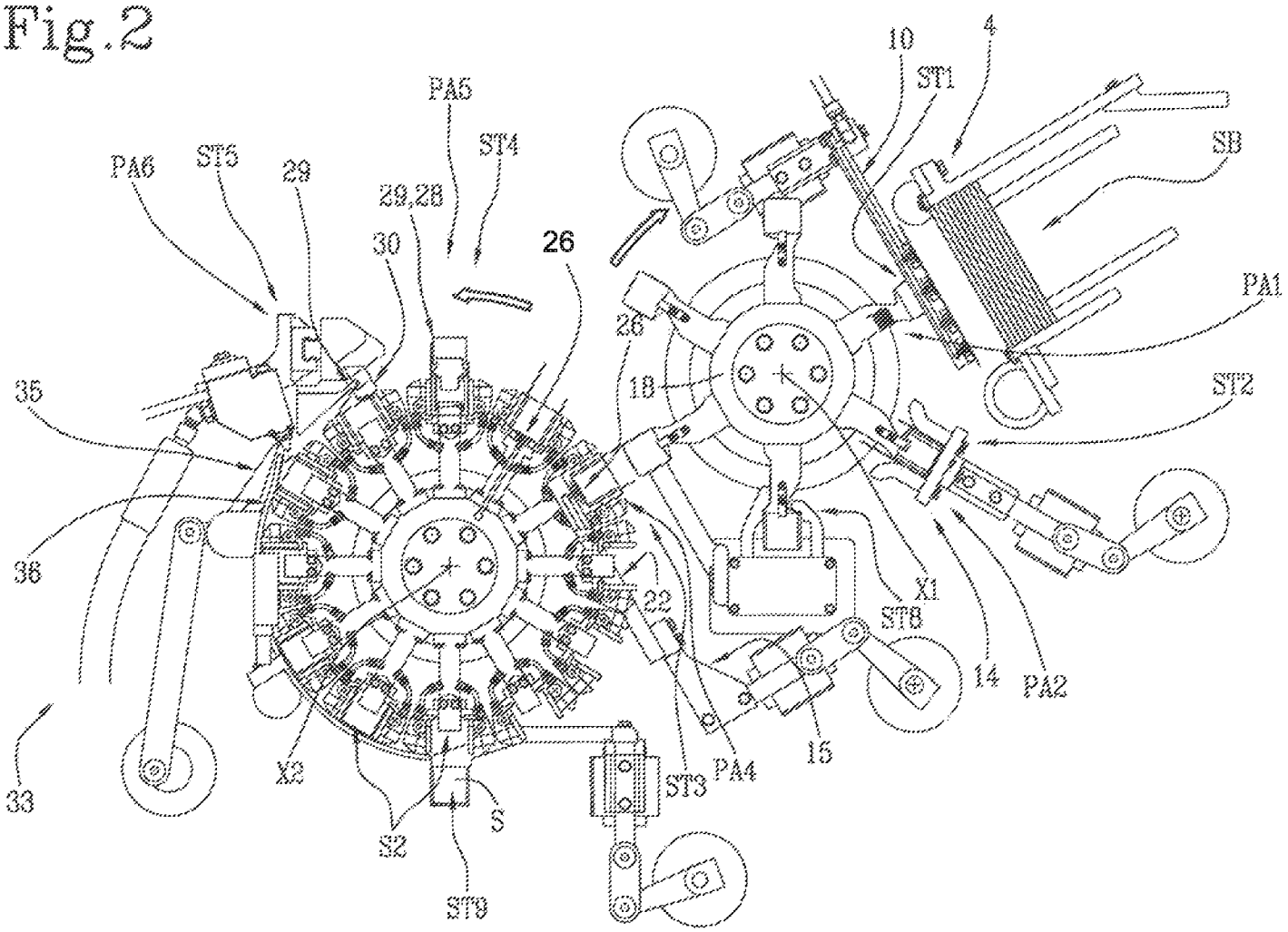

The deformation station ST8 is active on the first upper face SB4 and on the second upper face SB5, so as to weaken connecting hinges between the first upper face SB4 and the second lateral face SB3, and between the second upper face SB5 and the first lateral face SB2 (as illustrated in FIG. 2).

More specifically, advantageously, the deformation station ST8 guarantees that the blank SB does not tend to re-open due to the elastic return of the first and second upper faces SB4 and SB5.

It should be noted that, according to another aspect, in order to be certain that the preformed the blank SB is perfectly open at the filling station ST4, the unit 1 may also comprise a further station for partial reopening, coupled and/or integrated to the filling station ST4, designed to partly reopen the first and second upper faces SB4/SB5 (not illustrated), operating on the blank SB before the filling station ST4 (when the blank SB is coupled to the second receiving seat S2).

It should be noted that, preferably, the suction cups 13B and 13C are activated (to retain the blank SB) at the folding station ST2, so as to retain (against the projections 5) the lateral faces SB2 and SB3 of the blank (pushed by the mould 14 against the lateral faces of the projections 5).

The above-mentioned angular position of rotation of the first receiving seat S1 in which the deformation station ST8 is active is preferably after (or coincident with, in a variant embodiment not illustrated) the second angular position PA2 of rotation in which the folding station ST2 operates.

Preferably, as illustrated, the deformation station ST8 comprises at least a first and a second contact element (20, 21), movable between a non-operating position away from the first seat S1 (FIGS. 1 and 3) and an operating position close to the first seat S1 wherein the contact elements (20, 21) make contact with the first and second upper faces SB4 and SB5 of the blank SB for weakening the connecting hinges with the second lateral surface SB3 and the first lateral surface SB2, respectively (FIG. 2).

According to another aspect, the above-mentioned station ST3 for transferring the blank SB folded open from the first receiving seat S1 to the second receiving seat S2 comprises a transfer unit 15, which is movable between a position for contact with and picking up the blank SB folded open at the first receiving seat S1 and a position for releasing the blank SB folded open at the second receiving seat S2.

Preferably, the transfer unit 15 comprises a transfer element equipped with a plurality of prongs 22.

The prongs 22 are equipped with respective suction cups 26, which can be activated to retain the blank SB.

The prongs 22 are configured for inserting into cavities made between the second receiving seats S2.

More specifically, it should be noted that both the projections 23 and the projections 24 define together a plurality of circumferential cavities, in which the prongs 22 can be inserted.

Thus, the prongs 22 are inserted in the cavities made between the second receiving seats S2, with the suction cups 26 oriented parallel to the suction cups 27 of the bottom wall 25 of the second receiving seat S2.

More specifically, once the prongs 22 have been inserted in the cavity, the suction cups 27 of the projections 23, 24 and of the bottom wall 25 of the second seat S2 are activated to allow the blank S2 to be retained inside the second seat S2 (and the suction cups 26 of the prongs 22 are deactivated).

It should be noted that the so-called outer surface of the blank SB is resting on lateral walls of the projections 23 and 24 and on the bottom wall 25 which together form the second receiving seat S2.

According to yet another aspect, the unit 1 also comprises a station ST9 for releasing the box S, formed starting from the blank SB and containing the products, acting in a predetermined angular position of the second seat S2 (after the position of the first gluing station ST6 and preferably after the second gluing station ST7).

The release station ST9 comprises an arm 40 for picking up the box S containing the products, designed to transfer the box S in a subsequent line, or magazine, that is to say, container (not illustrated).

It should be noted that, preferably, the first rotary element 2 is driven step by step.

Also, preferably, the second rotary element 3 is actuated step by step.

It should be noted that the first rotary element 2 and the second rotary element 3 are actuated in a suitable synchronised fashion.

The invention will now be described in more detail, with reference to the insertion of a group of capsules in a box formed starting from a blank SB.

The arm 10, at the transfer station ST1, picks up a blank SB from the feeding magazine 4: it should be noted that the suction cups 12 of the prongs 11 are operating on the so-called "inner" surface of the blank SB.

The arm 10, after having picked up a blank SB, is moved, advantageously linearly, towards the first seat S1.

More precisely, the prongs 11 of the arm 10 are inserted between projection 5 and projection 5 (that is, between the projections 5 defined along a direction parallel to the first axis X1 of rotation), that is to say, in the cavity 6.

It should be noted that, during this step, the suction cups 13A of the projections 5 are activated and the suction cups 12 of the arm 10 are deactivated: in this way, the blank SB is retained only by the suction cups 13A of the projections 5.

At this point, upon completion of the transfer of the blank on the first seat S1, the rotary element 2 is moved, preferably by a step, in such a way as to move the seat S1 which retains the blank SB to the folding station ST2 (also referred to as the box pre-forming station).

At the folding station ST2, the first and the second lateral face SB2 and SB3 are substantially folded at 90° due to the movement of the mould 14 and the contact between the mould 14 and the faces (SB2/SB3).

More precisely, the elements 14A and 14B of the mould make contact with, fold and move the first and the second lateral faces SB2/SB3 in contact with the lateral walls of the projections 5, that is, in contact with the suction cups 13B and 13C (which are activated to retain the first lateral face SB2 and the second lateral face SB3, respectively).

It should also be noted that the further contact elements 14C, 14D and 14E fold the faces SB6, SB7, SB8, SB9, SB10 and SB11, respectively.

The blank SB is, at the end of the movement of the mould 14, configured as shown in FIG. 14.

It should be noted that, in the folding station ST2, the seventh lateral face SB10 and the ninth lateral face SB6 are positioned inside the fifth lateral face SB8, and the eighth lateral face SB11 and the tenth lateral face SB7 are positioned inside the sixth lateral face SB9.

It should also be noted that the movement of the mould 14 causes the fastening of the fifth lateral face SB8 and of the sixth lateral face SB9 to the two respective retaining elements 32, so as to maintain the folded configuration illustrated in FIG. 14.

It should be noted therefore that the fifth, seventh and ninth lateral faces SB10, SB8, SB6 (and, equally, the sixth, eighth and tenth lateral faces SB11, SB9 and SB7) are preferably retained in position by the retaining element 32.

Upon completion of the above-mentioned step at the folding station ST2, a step forward is made and the blank SB is moved successive station ST8 for deformation (or weakening) of the first and second lateral faces SB4 and SB5.

It should be noted that, at the deformation station ST8, the contact elements (20, 21) are moved from the non-operating position away from the first receiving seat S1 to the operating position close to the first receiving seat S1, wherein the contact elements (20, 21) make contact with the first and second upper faces SB4 and SB5 (as shown in FIG. 2).

The rotary element 2 is then rotated to move the seat S1 with the blank SB folded open to the second station ST3 for transferring the blank SB.

It should be noted that in this second station ST3 for transferring the blank SB, the transfer unit 15 is moved from the position for contact with and picking up the blank SB folded open at the first receiving seat S1 to the position for release of the blank SB folded open at the second receiving seat S2.

In this way, the transfer unit 15 transfers the blank SB from the first receiving seat S1 to the second receiving seat S2.

The activation of the suction cups 27 of the second receiving seat S2 means that the blank SB is retained inside the second receiving seat S2.

It should be noted that the second rotary element 3 is rotated advantageously in anticlockwise direction, until the blank SB is moved to the station ST4 for inserting capsules.

At the station ST4 for inserting capsules an arm inserts the capsules inside the space for containment of capsules defined by the blank SB.

Advantageously, the insertion station ST4, in particular the arm, is designed to insert the capsules inside the blank SB according to a direction of insertion which is perpendicular to a longitudinal direction of the box S. This makes it possible to obtain extremely short strokes of the arm, and therefore reduced insertion times.

Advantageously, the arm of the insertion station ST4 is movable along a direction of insertion radial relative to the second element 3.

It should therefore be noted that the blank SB is filled with a predetermined number of capsules.

The second rotary element 3 is then rotated further and the blank SB is positioned at the closing station ST5.

The first and second upper faces SB5 and SB4 are folded at the closing station ST5.

More specifically, it should be noted that the second upper face SB5 is folded by means of the element 30 of fixed type, whilst the first upper face SB4 is folded by means of the movable contact element 31.

It should be noted that the movable contact element 31 is movable between a non-operating position of non-interference with the first upper face SB4 and an operating position of interference with the first upper face SB4.

In a successive angular position (or according to a different variant, in the same angular position in which the closing station ST5 is operating), the gluing of the first and second upper face SB5 and SB4 to each other is substantially performed.

More specifically, as illustrated in FIG. 2, the first gluing device 33 distributes a layer of glue on the first upper face SB4, even more specifically on an outer surface of the first upper face SB4.

The first device 33 is preferably movable along the direction of the second axis X2 of rotation, for distributing a layer of glue in a plurality of predetermined points (continuous or discontinuous) of the outer surface of the first upper face SB4.

It should be noted that the third and fourth lateral faces SB12 and SB13 are inserted inside, respectively, the fifth and sixth SB8 SB9 lateral faces.

It should be noted that the unit 1 also comprises a movable device 35 for contact of the first SB5 and the second SB4 upper face, operating downstream of the first gluing station ST6.

The device 35 is movable between a position of non-interference with the first SB4 and the second SB5 upper face and an operating position, in which it comes into contact with the second face SB5 to push it into contact with the first upper face SB4, in the final closing position.

It should be noted that the unit 1 also comprises an element 36, that is, a contact guide, suitably shaped, configured to keep the second upper face SB5 in contact with the first upper face SB4 in the final closing position, positioned and operational downstream of the movable contact device 35.

Preferably, the element 36, that is, the contact guide, operates on the second upper face SB5 during the rotation of the second rotary element 3 towards the release station.

In the next step the blank SB is moved to the second gluing station ST7.

At the second gluing station ST7, the second glue releasing device 34 glues the fourth lateral face SB13 on the sixth lateral face SB9 and the third lateral face SB12 on the fifth lateral face SB8 (FIG. 6).

It should be noted that the unit 1 also comprises a pair of contact elements, acting on the fifth and on the sixth lateral face SB8 and SB9 after gluing by the second gluing device 34, to keep the fifth and the sixth lateral face SB8 and SB9 pressed, respectively, against the third lateral face SB12 and the fourth lateral face SB13 (in order to allow the adhesion by the glue).

It should be noted that the blank SB opened up, containing the capsules and closed using the gluing (thus defining a package or box S) is moved to the release station ST9.

The picking up arm 40, in the release station ST9, grips the box S and detaches it from the second seat S2 (upon this gripping operation, the suction cups 27 operating on the second seat S2 are deactivated).

With reference to FIGS. 12 to 18, it should be noted that these drawings illustrate the steps of folding, closing and gluing performed in the different stations of the unit 1.

It should be noted that this invention also defines a machine for making boxes containing single-use capsules containing a product, preferably single-use capsules containing infusion or extraction product, comprising a plurality of stations configured for operating in a synchronised fashion, comprising at least:

- a station for feeding rigid bodies into corresponding seats of a transport element;
- a station for filling rigid containers with a predetermined quantity of product;
- a station for closing rigid containers, in particular an upper opening of the rigid container, with a piece of closing sheet to form capsules;
- an outfeed station which picks up the capsules from the respective seats of the transport element; and the boxing unit 1 described previously.

In addition to the stations listed above, the machine for making boxes of capsules may comprise further stations, such as, for example, one or more weighing stations, one or more cleaning stations, one or more control stations and, depending on the type of capsule to be packaged, one or more stations for applying filtering elements.

An advantage of this invention is to have provided a boxing unit 1 which is particularly simple to use and which can constitute a valid alternative to the of the existing types of boxing machines/units.

Another advantage of this invention is to provide a machine 1 which is particularly fast, is able operate at particularly high operating speeds, and has a reduced size.

The invention also defines a method for boxing packaged food products (in particular capsules containing extraction and infusion products) comprising the following steps:

- preparing a flat blank SB equipped with a plurality of lateral faces (SB2, SB3, SB6, SB7, SB8, SB9, SB10, SB11, SB12, SB13), at least one upper face (SB4, SB5) and a lower, or bottom, face (SB1);
- preparing a first rotary element 2 equipped with at least one projection 5 (defining a first receiving seat S1);
- preparing a second rotary element 3 equipped with at least a second receiving seat S2 (preferably defined by a pair of projections (23, 24) and by a bottom wall 25 interposed between the projections (23, 24));
- coupling the blank SB, preferably in a flat configuration, with the projection 5 in a first predetermined angular position of rotation of the first receiving seat S1;
- folding at least one lateral face (SB2, SB3, SB6, SB7, SB8, SB9, SB10, SB11, SB12, SB13) in a second angular position of rotation of the first receiving seat S1; transferring the blank SB from the first rotary element 2 to the second rotary element 3, at a third angular position PA3 of rotation of the first receiving seat S1 and a first angular position PA4 of rotation of the second receiving seat S2;
- inserting the packaged food products inside the blank SB with the blank SB retained in the second seat S2;
- closing, advantageously by gluing, the blank SB to define a box S.

It should be noted that, preferably, the step of folding at least one lateral face (SB2, SB3, SB6, SB7, SB8, SB9, SB10, SB11, SB12, SB13) of the blank SB in a second angular position of rotation of the first receiving seat S1 is carried out by means of a mould 14, with the blank SB coupled to the projection 5.

Advantageously, the step of closing the blank SB comprises the step of folding a first and a second upper face (SB4, SB5), and, if necessary, other lateral faces, and gluing the same, so as to close the blank containing the packaged food products and define a box S.

According to another aspect, the step of transferring the blank from the first rotary element 2 to the second rotary element 3 comprises a step of positioning the blank SB inside the second seat S2 in such a way that the surface of the blank SB which faces towards the outside when the blank SB is coupled to the projection 5 of the first receiving seat S1 faces towards the inside of the second receiving seat S2.

According to another aspect, the method comprises a step of weakening at least one connecting hinge between upper faces and respective lateral faces of the blank SB.

According to this aspect, the method preferably comprises a step of deforming connecting hinges between a first lateral face SB2 and second upper face SB5, and second lateral face SB3 and first upper face SB4.

Advantageously, the step of inserting the packaged food products inside the blank SB comprises inserting the packaged food products according to a direction of insertion which is perpendicular to a longitudinal direction of the box S.

Lastly, a further, that is, a second embodiment, is now described (illustrated in FIGS. 19 to 21), as an alternative to the first embodiment.

It should be noted that, according to this second embodiment, each first seat S1 is movable between a first and a second position.

Preferably, each first seat S1 is movable radially relative to the first axis X1 of the first rotary element 2.

Preferably, each projection 5 which defines the first seat S1 is movable along an arm 41.

Each arm 41 is moved radially by the first rotary element 2.

Preferably, each first seat S1 is movable radially relative to the first axis X1 of the first rotary element 2 between a first position close to the axis of rotation X1 of the first rotary element 2 and a position away from the axis of rotation X1 of the first rotary element 2.

Figure 19:
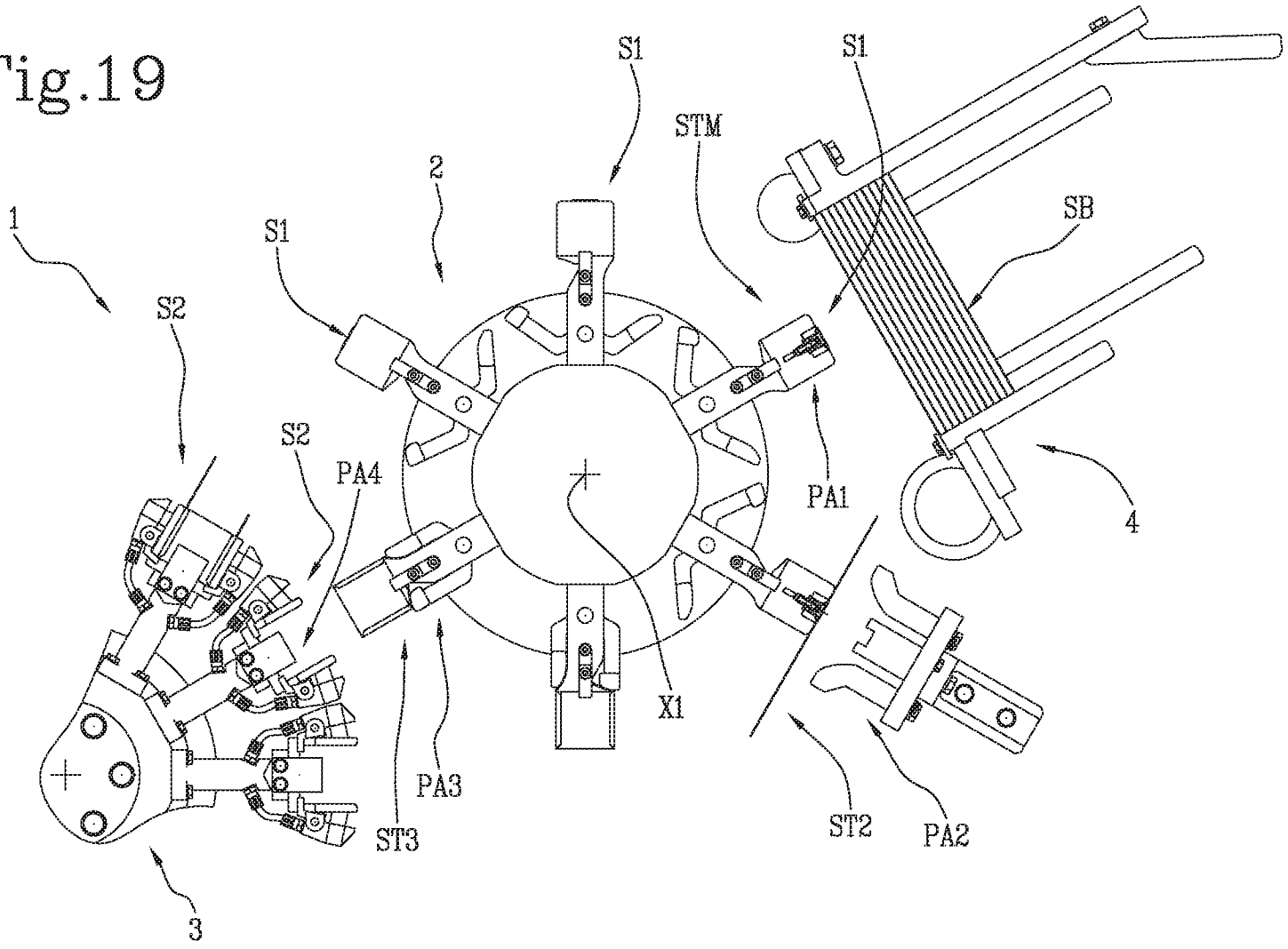
FIGS. 19 to 21 illustrate respective schematic front views, partly in cross section according to a vertical plane, of a unit for packaging single-use capsules according to the invention in different operating configurations according to a second embodiment.
Figure 20:
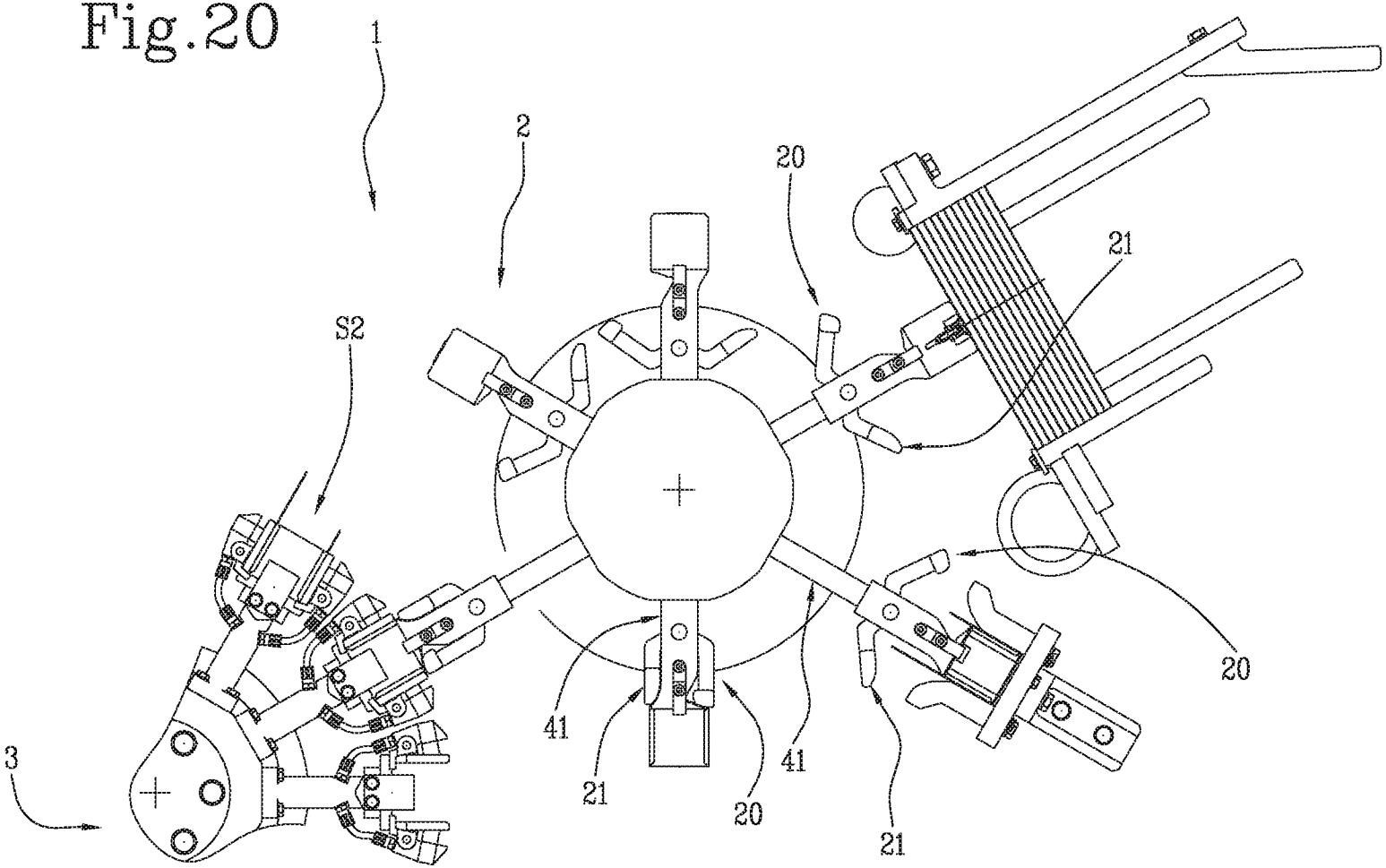
Figure 21:
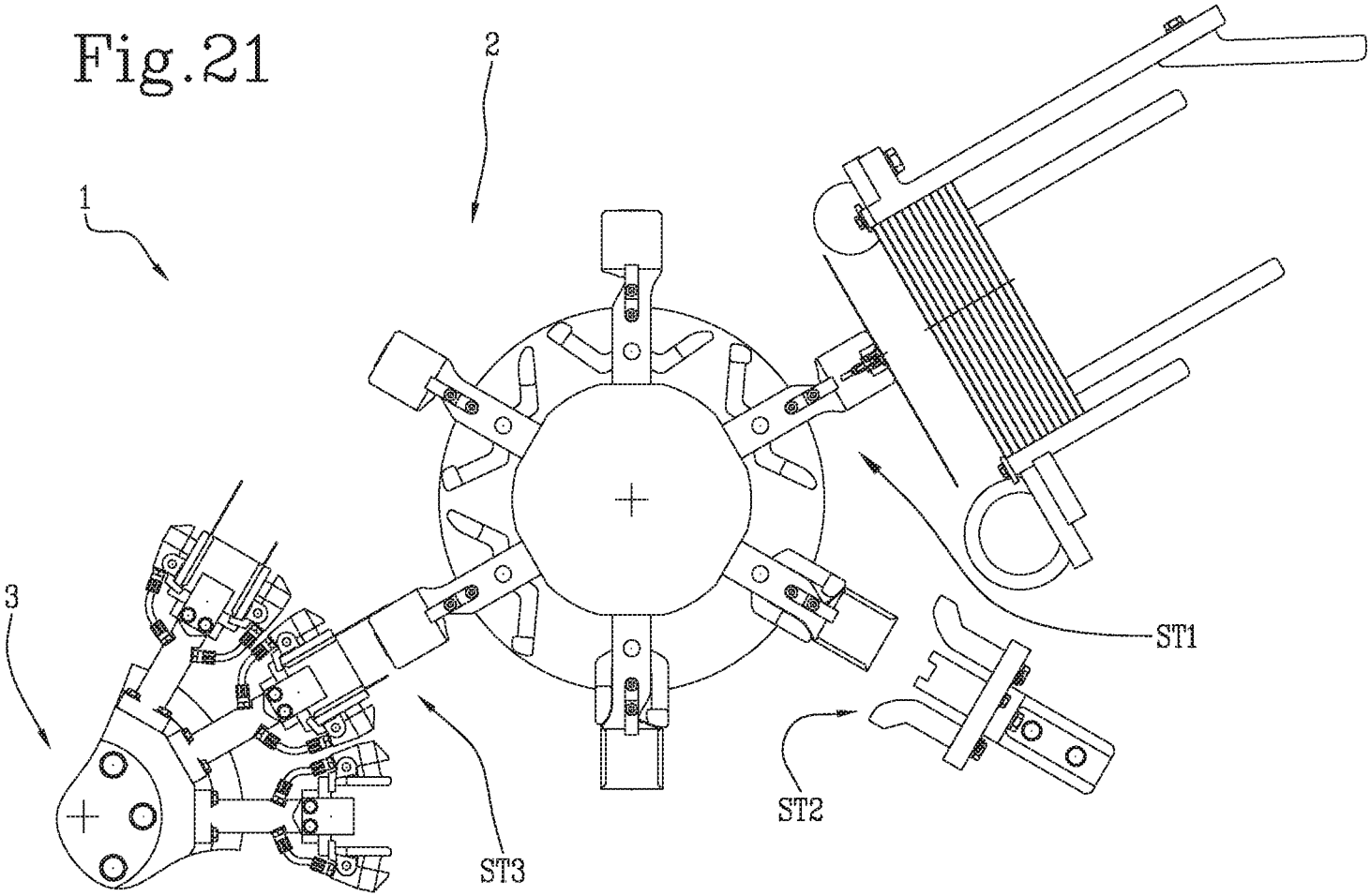
Figure 22:
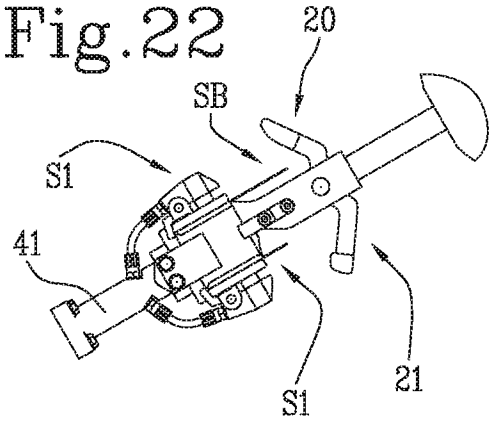
FIGS. 22 to 26 illustrate respective operating steps of a detail of the boxing unit of FIGS. 19 to 21.
Figure 23:
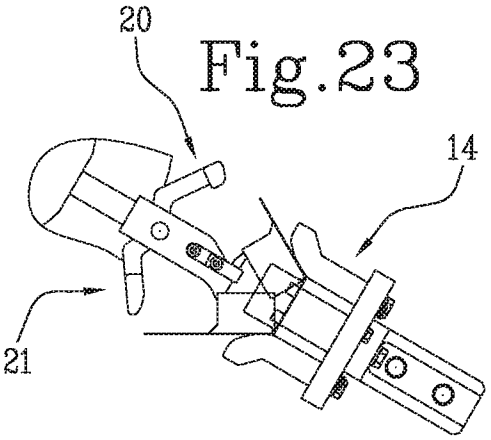
Figure 24:
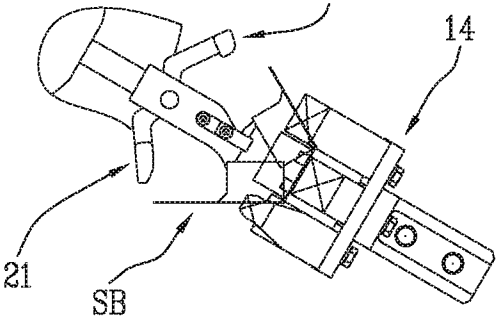
Figure 25:
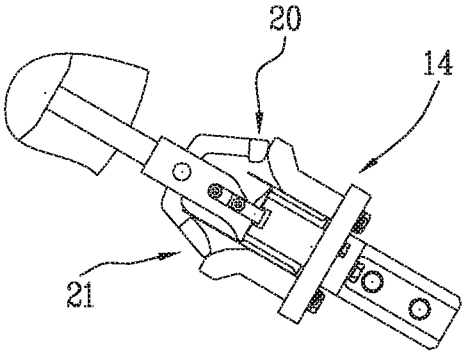
Figure 26:
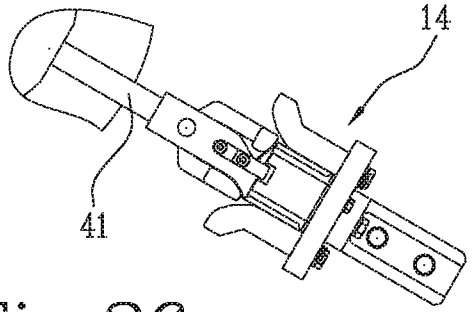

As shown in FIGS. 19 to 21, the first seat S1 is positioned in the position far from the axis of rotation X1 of the first rotary element 2 at the first position PA1, where the transfer of the blank from the magazine 4 to the first seat S1 is performed.

More specifically, at the first angular position PA1, in order to transfer the blank from the magazine 4 to the first seat S1, the first seat S1 is moved in such a way that it is positioned in the far position: in this far position the suction cups positioned on the upper face of the first seat S1 are in effect in contact with the surface of the blank SB, so as to retain the blank itself.

The first seat S1 is moved towards the first close position, picking up the blank from the feeding magazine 4. In short, in the embodiment illustrated in FIGS. 19-21, the first seat S1 in the first angular position PA1 defines the first transfer station ST1.

It should be noted that, after transferring the blank from the magazine 4 to the first seat S1, the first seat S1 is moved from the far position to the position close to the first axis of rotation X1.

It should also be noted that, according to the embodiment illustrated in FIGS. 19 to 21, the contact elements 20 and 21 are associated with (that is, supported by) each first seat S1.

More specifically, each first seat S1 is equipped with relative contact elements 20 and 21.

It should be noted that, according to this embodiment of FIGS. 19 to 21, the mould 14 may be stationary, that is fixed to the frame, or it may be movable (preferably radially relative to the axis X1 of rotation of the first rotary element 2). It should be noted that, if the mould 14 is stationary, the first seat S1 is moved to the station ST2 from the near position towards the far position, so as to move the blank SB into contact with the mould 14 itself. It should also be noted that, in this case, the folding of the faces to allow the opening up of the blank SB is performed according to the same methods illustrated and described above with reference to the first embodiment (see, in this regard, the sequence illustrated in FIGS. 22 to 26).

After opening the blank SB by means of the mould 14 (mobile or stationary) the contact elements 20 or 21 can be advantageously operated, for deforming the upper faces SB4, SB5 of the blank, or in other words for weakening the connecting hinges between the first upper face SB4 and the second lateral face SB3, and between the second upper face SB5 and the first lateral face SB2.

The contact elements 20, 21 may operate in any angular position of, that is to say, along any arc path from, the first seat S1, downstream of the folding station ST2 and upstream of the second transfer station ST3.

In the embodiment of FIGS. 19-21, each pair of folding elements 20, 21 defines the deformation station ST8.

It should also be noted that, preferably, after opening up the blank SB, the first seat S1 is moved from the far position to the close position.

It should also be noted that, at the second transfer station ST3, the first seat S1 is moved from the close position to the far position, so as to release the blank SB opened up in the second seat S2 (see FIGS. 19 and 20).

The invention claimed is:

1. A unit for boxing packaged food products, comprising:

a first rotary element, rotatable about a first axis of rotation and comprising a first receiving seat for receiving a blank and configured to rotate the first receiving seat in a plurality of angular positions of rotation;

a first transfer station for transferring a blank in a spread-out configuration from a magazine for feeding blanks to the first receiving seat, acting at a first angular position of rotation of the first receiving seat;

a folding station for opening up, at least partly, the blank positioned on the first receiving seat, acting in a second angular position of rotation of the first receiving seat, the first rotary element including at least one projection defining the first receiving seat;

a second rotary element rotatable about a second axis and comprising a second receiving seat for receiving the blank folded open;

a second transfer station for transferring the blank folded open from the first receiving seat to the second receiving seat, acting at a third angular position of rotation of the first receiving seat and at a first angular position of rotation of the second receiving seat;

for inserting the packaged food products inside the blank folded open and positioned on the second receiving seat, acting in a second angular position of rotation of the second receiving seat;

a closing station for closing the blank folded open and positioned on the second receiving seat and containing the packaged food products to define a box, acting in a third angular position of rotation of the second receiving seat.

2. The unit according to claim 1, further comprising a first gluing station for gluing first portions of the blank folded open and positioned on the second receiving seat and containing the packaged food products, acting in a fourth angular position of rotation of the second receiving seat.

3. The unit according to claim 1, further comprising a deformation station configured to weaken connecting hinges between a first upper face and a second lateral face and between a second upper face and a first lateral face of the blank, subsequent to or coincident with the second angular position of rotation in which the folding station is operating.

4. The unit according to claim 1, wherein the first rotary element comprises a plurality of the first receiving seats, arranged in different angular positions of the first rotary element, each of the first receiving seats being configured to receive a blank and wherein the second rotary element comprises a plurality of the second receiving seat, arranged in different angular positions, each of the second seats being configured to receive a blank.

5. The unit according to claim 1, wherein the at least one projection includes a plurality of projections defining the first receiving seat, positioned substantially aligned along a direction parallel to the first axis of rotation and defining, between them, respective cavities.

6. The unit according to claim 5, wherein the first transfer station comprises a transfer arm, having a plurality of prongs, movable between a picking up position, wherein the transfer arm picks up the blank from the magazine for feeding blanks, and a releasing position, wherein the transfer arm releases the blank on the first receiving seat, wherein the prongs are positioned inside the cavities.

7. The unit according to claim 6, wherein the prongs comprise a plurality of suction cups, positioned facing towards the magazine for feeding blanks for retaining the blank.

8. The unit according to claim 1, wherein the first receiving seat is movable radially relative to the first axis of the first rotary element.

9. The unit according to claim 1, wherein the at least one projection comprises a plurality of suction cups, configured to retain the blank in a predetermined position.

10. The unit according to claim 1, wherein the folding station comprises a mold configured to make contact with and fold lateral walls of the blank, when the blank is coupled to the at least one projection.

11. The unit according to claim 10, wherein the mold is movable radially between a non-operating position away from the first receiving seat and an operating position close to the first receiving seat in which the mold comes into contact with and folds lateral walls of the blank.

12. The unit according to claim 1, further comprising a deformation station, acting at a fourth angular position of the first receiving seat, subsequent to or coincident with the second angular position of rotation in which the folding station is operating, and wherein the deformation station comprises a first contact element and a second contact element, movable between a non-operating position away from the first receiving seat and an operating position close to the first receiving seat wherein the first and second contact elements make contact with upper faces of the blank to weaken connecting hinges between the upper faces and a respective lateral face.

13. The unit according to claim 1, wherein the second transfer station comprises a transfer unit, movable between a contact and pick up position, wherein the transfer unit makes contact with and picks up the blank folded open at the first receiving seat, and a release position, wherein the transfer unit releases the blank folded open in the second receiving seat.

14. The unit according to claim 1, wherein the second receiving seat is defined by a first series of radial projections, aligned with each other along a direction parallel to the second axis of rotation, by a second series of radial projections, aligned with each other along a direction parallel to the second axis of rotation, and by a bottom wall, the radial projections of the second series being positioned relative to the radial projections of the first series in different and adjacent radial positions.

15. The unit according to claim 1, wherein the insertion station is configured for inserting the packaged food products inside the blank along a direction of insertion which is perpendicular to a longitudinal direction of the box.

16. A method for boxing packaged food products comprising the following steps:

providing a blank equipped with a plurality of lateral faces, at least one upper face and a bottom face;

providing a first rotary element including projection defining a first receiving seat;

providing a first transfer station for transferring the blank in a spread-out configuration from a magazine for feeding blanks to the first receiving seat, acting at a first angular position of rotation of the first receiving seat;

providing a folding station for opening up, at least partly, the blank positioned on the first receiving seat, acting in a second angular position of rotation of the first receiving seat, the first rotary element including at least one projection defining the first receiving seat;

providing a second rotary element rotatable about a second axis and including a second receiving seat for receiving the blank folded open;

providing a second transfer station for transferring the blank folded open from the first receiving seat to the second receiving seat, acting at a third angular position of rotation of the first receiving seat and at a first angular position of rotation of the second receiving seat;

providing an insertion station for inserting the packaged food products inside the blank folded open and positioned on the second receiving seat, acting in a second angular position of rotation of the second receiving seat;

providing a closing station for closing the blank folded open and positioned on the second receiving seat and containing the packaged food products to define a box, acting in a third angular position of rotation of the second receiving seat;

coupling the blank to the projection at the first angular position of rotation of the first receiving seat;

folding at least one lateral face of the blank at the second angular position of rotation of the first receiving seat;

transferring the blank from the first rotary element to the second rotary element, at the third angular position of rotation of the first receiving seat and the first angular position of rotation of the second receiving seat;

inserting the packaged food products inside the blank retained in the second receiving seat;

closing the blank to define a box.

17. The method according to claim 16, wherein the step of folding at least one lateral face of the blank in the second angular position of rotation of the first receiving seat is carried out via a mold, with the blank coupled to the projection.

18. The method according to claim 17, wherein the step of transferring the blank from the first rotary element to the second rotary element comprises a step of positioning the blank inside the second receiving seat in such a way that a surface of the blank which faces towards an outside when the blank is coupled to the projection of the first receiving seat faces towards an inside of the second receiving seat.

19. The method according to claim 16, wherein the step of inserting the packaged food products inside the blank comprises a step of inserting the packaged food products according to a direction of insertion which is perpendicular to a longitudinal direction of the box.

* * * * *